US007448887B2

(12) United States Patent
Ikeya et al.

(10) Patent No.: US 7,448,887 B2
(45) Date of Patent: Nov. 11, 2008

(54) LEVER-FITTING TYPE CONNECTOR

(75) Inventors: Kenichi Ikeya, Shizuoka-ken (JP); Tsuneyuki Takahashi, Atsugi (JP); Takahiro Yoneda, Atsugi (JP); Ryo Sawada, Atsugi (JP); Yasuhiro Sasaki, Shizuoka-ken (JP); Ken Yoshimura, Atsugi (JP); Nozomi Ito, Tochigi-ken (JP); Shigeru Tanaka, Tochigi-ken (JP)

(73) Assignees: Yazaki Corporation, Tokyo (JP); Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/661,933

(22) PCT Filed: Sep. 6, 2005

(86) PCT No.: PCT/JP2005/016302

§ 371 (c)(1),
(2), (4) Date: Mar. 12, 2008

(87) PCT Pub. No.: WO2006/028075

PCT Pub. Date: Mar. 16, 2006

(65) Prior Publication Data

US 2008/0194129 A1 Aug. 14, 2008

(30) Foreign Application Priority Data

Sep. 7, 2004 (JP) ..... 2004-259748

(51) Int. Cl.
*H01R 13/62* (2006.01)

(52) U.S. Cl. ..... 439/157

(58) Field of Classification Search ..... 439/157–164
See application file for complete search history.

(56) References Cited

U.S. PATENT DOCUMENTS

| | | | | |
|---|---|---|---|---|
| 4,454,398 | A * | 6/1984 | Aschenbach et al. | 200/302.3 |
| 7,367,833 | B2 * | 5/2008 | Matsumoto | 439/321 |
| 2005/0038386 | A1 * | 2/2005 | Fago et al. | 604/113 |
| 2005/0227518 | A1 * | 10/2005 | Hartman | 439/157 |

FOREIGN PATENT DOCUMENTS

| | | |
|---|---|---|
| JP | 6-13069 | 2/1994 |
| JP | 6-29066 | 2/1994 |
| JP | 7-29765 | 6/1995 |
| JP | 9-129313 | 5/1997 |
| JP | 11-67325 | 3/1999 |

* cited by examiner

*Primary Examiner*—Briggitte R Hammond
(74) *Attorney, Agent, or Firm*—Finnegan, Henderson, Farabow, Garrett & Dunner, L.L.P.

(57) ABSTRACT

A lever-fit connector, wherein a rotation prevention lock (12) preventing a lever (5) from being rotated when male and female connector housing are fitted (joined) to each other is installed in the inner wall (6A) of a lever insert hole (6) in a female housing (2). A rotation lock recessed part (58) in which the rotation lock part (12D) of the rotation prevention lock (12) is engageably stored is formed in the peripheral surface of the lever (5). The angle of the rotation lock part (12D) is set so that the rotation lock part (12D) is drawn to the lever (5) side in excessive rotation by bringing the rotation lock part (12D) into contact with the side wall surface (58B) of the rotation lock recessed part (58).

7 Claims, 12 Drawing Sheets

LEVER-FITTING TYPE CONNECTOR

TECHNICAL FIELD

The present invention relates to a lever-fitting type connector capable of fitting or disconnecting a female connector and a male connector into or from each other by a lever rotating operation.

BACKGROUND ART

There is conventionally known a connector having a fitting-operation cam bolt (lever) for fitting a female connector into a male connector by rotating the cam bolt (Japanese Utility Model Examined Publication No. H07-41103). This connector is configured so that cam-bolt insertion holes are formed in the both connectors and a protrusion to be accommodated in a screw groove formed on a circumferential surface of the cam bolt is provided in the insertion hole of one of the connectors. The connector is moved toward the other connector by rotating the cam bolt, thereby fitting the paired connectors into each other.

DISCLOSURE OF THE INVENTION

Although the above-state conventional connector is configured to stop rotation of the cam bolt at a position at which the paired connectors are fitted into each other, it fails to include a lock mechanism for holding fitting of these connectors.

If the lock mechanism is to be provided in such a connector, a lock mechanism could normally be provided in the insertion hole of the cam bolt. However, if force is applied to a grip of the cam bolt, considerably strong force is applied to the insertion hole of the cam bolt. To satisfy the standard of the force for holding engagement of the cam bolt, it is necessary to make the lock mechanism itself stronger. If a stopper piece to be stopped at the cam bolt, for example, is provided as the lock mechanism at connector side and this stopper is made stronger, it is difficult to bend the stopper piece at the time of releasing the lock. As a result, lock releasing operability may possibly be deteriorated. If such a stopper piece is employed as the lock mechanism, it is difficult to simultaneously satisfy improvement in locking force and reduction in lock releasing force.

It is, therefore, an object of the present invention to provide a lever-fitting type connector that can ensure high connecting force for connecting two connector housings to each other and good lock releasing operability.

According to an aspect of the present invention, there is provided a lever-fitting type connector comprising: a first connector housing; a second connector housing to be fitted into the first connector housing; and a lever rotatably held by the first connector housing, drawing the second connector housing by being rotated to fit the first connector housing and the second connector housing into each other, wherein the first connector housing includes an insertion hole into which the lever is to be inserted, and an anti-rotation lock that includes an abutment member abutting on an abutted member provided on the lever for preventing over-rotation of the lever is provided on an inner wall of the insertion hole, and wherein an abutment surface of the abutment member in a circumferential direction of the insertion hole and an abutted surface of the abutted member in a circumferential direction of the lever are inclined so that the abutment member is drawn toward the lever when the lever is over-rotated.

With the above configuration, the abutment member of the anti-rotation lock provided on the inner wall of the first connector housing abuts on the abutted member of the lever, thereby making it possible to prevent over-rotation of the lever. Further, the abutment surface of the abutment member abuts on the abutted surface of the abutted member and is inclined so as to be drawn toward the lever. It is, therefore, difficult to release engagement between the abutment member and the abutted member and possible to ensure holding a fitting state where the connector housings are fitted into each other.

The abutted surface can be formed on each of both sides of the abutted member in the circumferential direction of the lever.

With the above configuration, since the abutted surface is formed on each of the both sides of the abutted surface in the circumferential direction of the lever, one of the both abutted surfaces is abutted against the abutment member of the anti-rotation lock according to the rotation direction of the lever. It is, therefore, possible to prevent the lever from being rotated in any direction circumferentially and prevent the lever from being erroneously rotated.

The abutted member can be a rotation-locking concave portion formed on a circumferential surface of the lever.

With the above configuration, the rotation-locking concave portion formed on the circumferential surface of the lever is used as the abutted member, whereby whichever inner wall surface of the rotation-locking concave portion in the circumferential direction of the lever is abutted against the abutment member, thus preventing rotation of the lever.

Furthermore, the anti-rotation lock can include a support member protruding toward a center of the insertion hole; a lock releasing unit extending from the support member in an opposite direction to an insertion direction of the lever; a pair of arm members extending from the lock releasing unit in the insertion direction of the lever, the support member present between the pair of arms; and the abutment member formed to be connected to tip ends of the pair of arm members.

With the above configuration, the anti-rotation lock has a so-called seesaw lock structure in which the lock releasing unit and the abutment member connected to the pair of arm members are rotated with the support member used as a fulcrum. Therefore, by weakly pressing the lock releasing unit from outside, it is possible to easily release the lever rotation lock.

Moreover, the lock releasing unit can be exposed to an opposite side of the first connector housing to a direction in which the first connector housing is fitted into the second connector housing.

With the above configuration, the lock releasing unit is exposed to the opposite side of the first connector housing to the direction in which the first connector housing is fitted into the second connector housing. Accordingly, the lock releasing unit can be operated from the inlet side of the lever insertion of the first connector housing, thereby making it possible to improve operability.

Furthermore, the first connector housing is covered with a waterproof cover having flexibility, and the lock releasing unit can be operated from an outside of the waterproof cover.

With the above configuration, since the lock releasing unit can be operated from the outside of the waterproof cover that covers up the first connector housing, it is possible to improve operability.

Moreover, a release-operation concave portion that enables operating the lock releasing unit can be formed in the waterproof cover.

With the above configuration, since the release-operation concave portion that enables operating the lock releasing unit is formed in the waterproof cover, it is possible to easily press the lock releasing unit of the anti-rotation lock by inserting a finger into this release-operation concave portion and to improve release operability.

BEST MODE FOR CARRYING OUT THE INVENTION

A lever-fitting type connector according to an embodiment of the present invention is explained below in detail.

The outline of the lever-fitting type connector according to the embodiment of the present invention is as follows. A lever having a rod-like part rotatably inserted into and held by a female housing that serves as a first connector housing is rotated, whereby a male housing serving as a second connector housing is drawn and the both connector housings are fitted into each other. An insertion hole for inserting the lever is provided in the female housing. On an inner wall of this insertion hole, an anti-rotation lock that prevents rotation of the lever when the female and male connector housings are fully engaged (connected) is provided. Further, a rotation-locking concave portion that serves as an abutted member is formed on a circumferential surface of the lever to correspond to this anti-rotation lock.

On the inner wall of this insertion hole, not only the anti-rotation lock but also a rib that causes the lever to be insertable into the female housing only when the lever is located at a predetermined rotation position and a lever-holding lock having flexibility are provided. This rib is configured to abut on a retaining unit provided on the lever simultaneously with the lever-holding lock, to prevent the lever from coming off, and to hold the lever.

Figure 1:
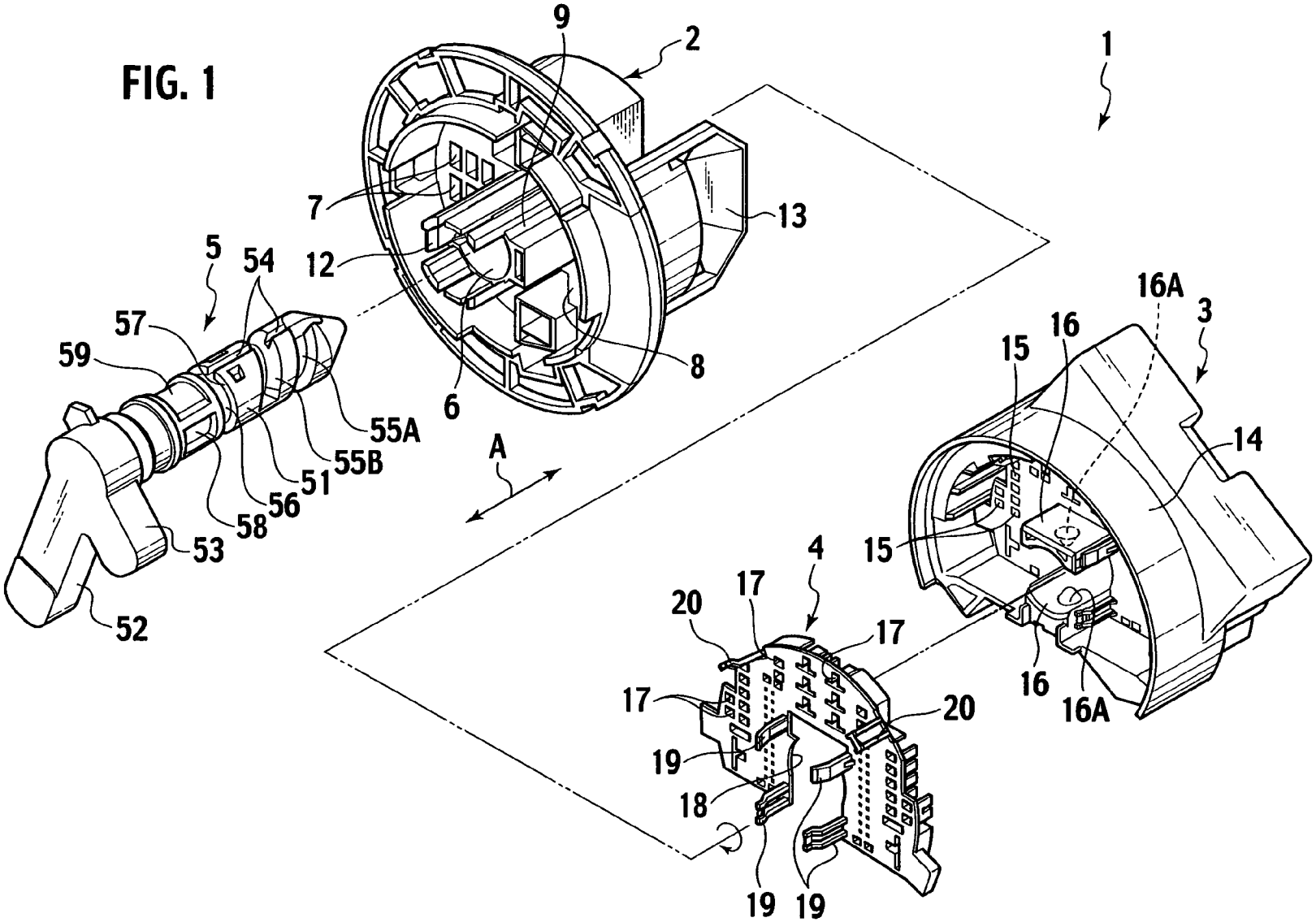
FIG. 1 is an exploded perspective view of a lever-fitting type connector according to an embodiment of the present invention.
Figure 2:
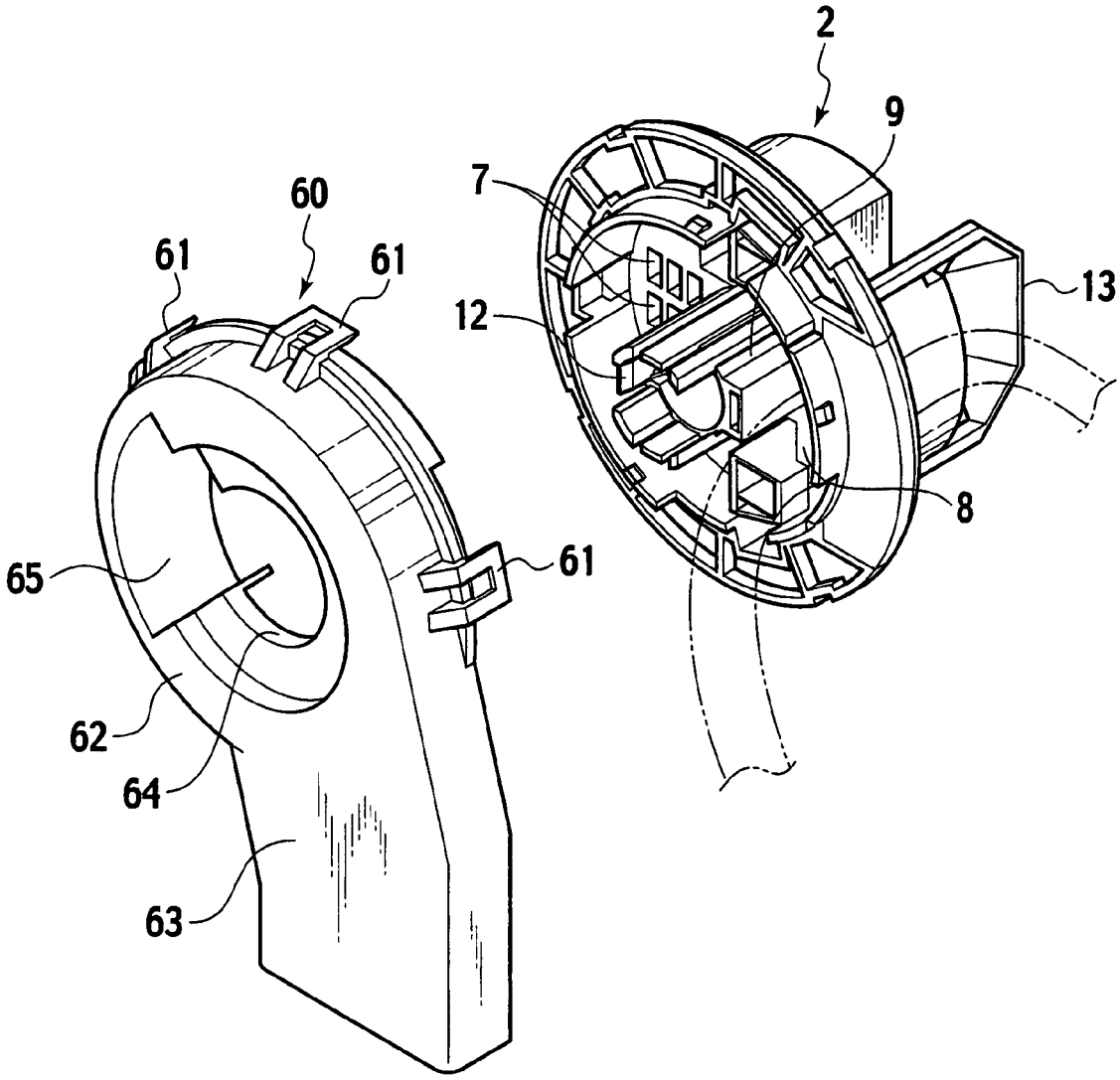
FIG. 2 is a perspective view of a female housing 2 and a female housing cover according to the embodiment of the present invention.
Figure 3:
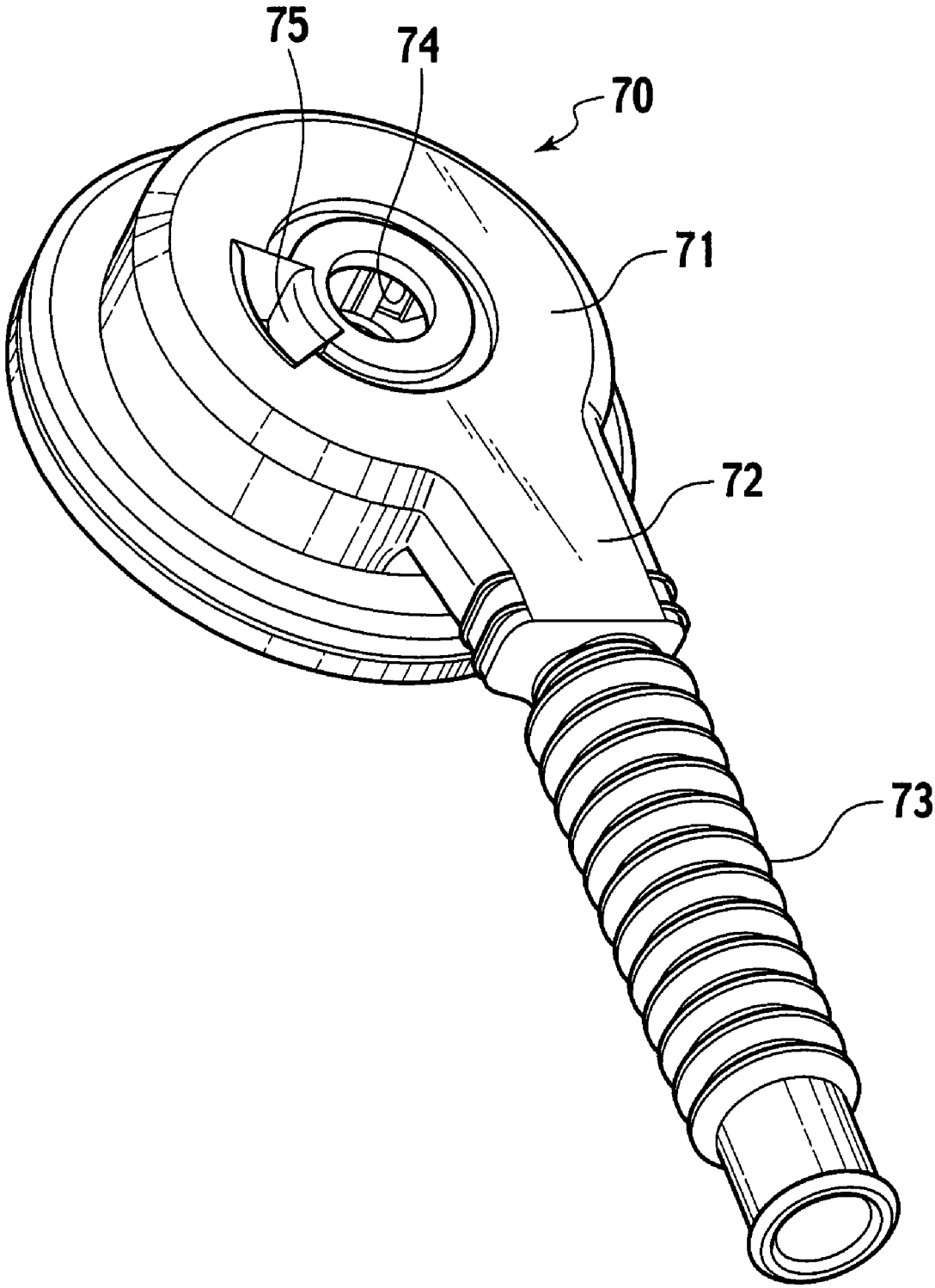
FIG. 3 is a perspective view of a grommet according to the embodiment of the present invention.
Figure 5:
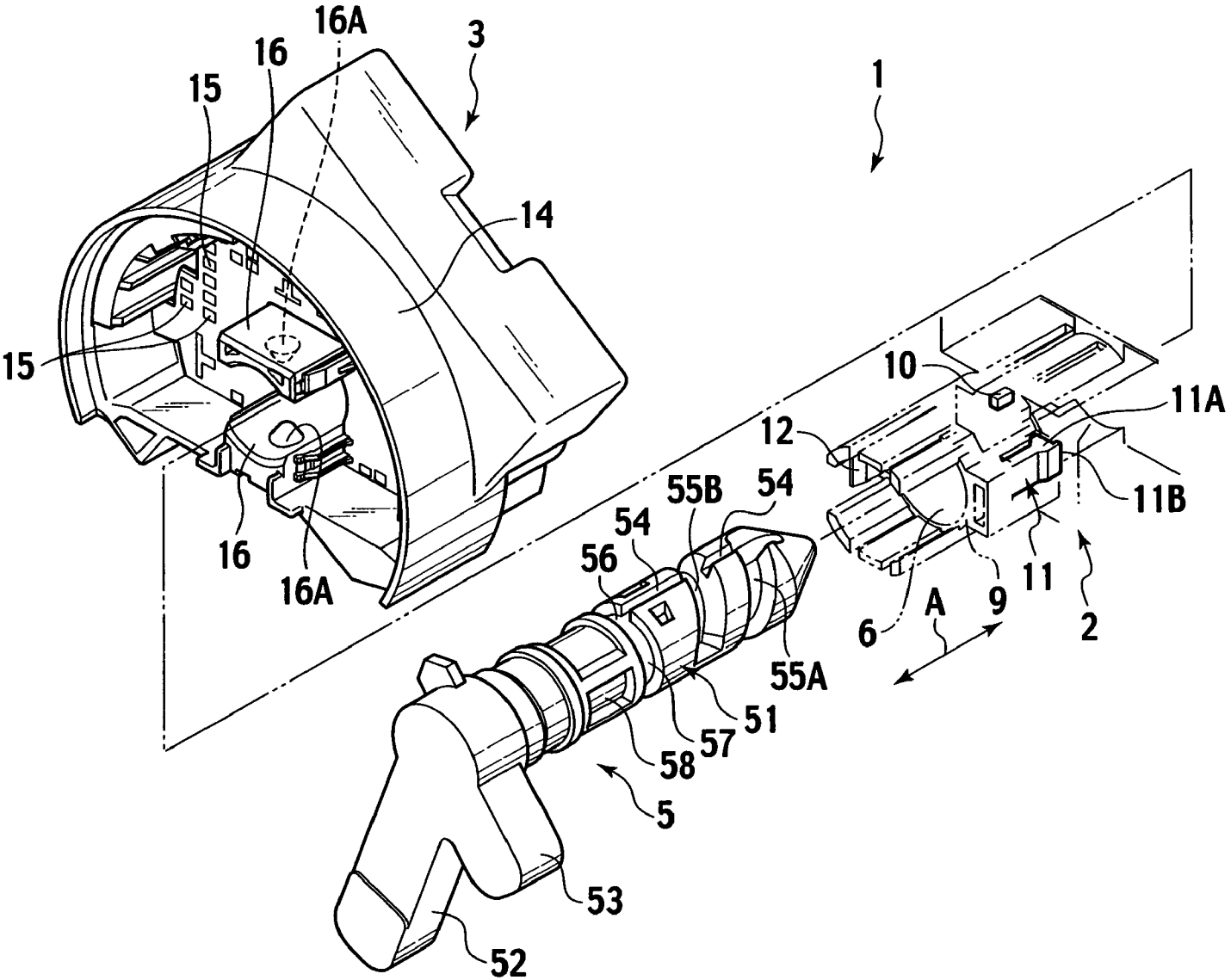
FIG. 5 is an exploded side view of the lever-fitting type connector according to the embodiment of the present invention.

The lever-fitting type connector according to the present embodiment will be described specifically based on the drawings. As shown in FIG. 1, a lever-fitting type connector 1 according to the embodiment roughly includes a female housing 2, a male housing 3, a moving plate 4, and a lever 5. A female housing cover 60 shown in FIG. 2 is attached onto the female housing 2. Further, a rubber grommet 70 is attached, as a flexible cover as shown in FIG. 3, onto the female housing 2 while the female housing cover 60 is attached onto the female housing 2. FIG. 5 is a perspective view showing a state where the moving plate 4 is temporarily stopped at the male housing 3, in which view the female housing cover 60 and the grommet 70 are not shown.

[Configuration of Female Housing]

As shown in FIG. 1, a lever insertion hole 6 penetrating the female housing 2 in fitting directions A (indicated by an arrow) and serving as an insertion hole is formed generally at center in the female housing 2. A plurality of cavities 7 penetrating the female housing 2 along the fitting directions A is formed around the lever insertion hole 6 in the female housing 2. A female-terminal metal fitting (not shown) is stored and held in each of the cavities 7.

A through wiring path 8 which an electric wire (indicated by a chain line in FIG. 2) can be inserted into and arranged in from one of the fitting directions A to the other fitting direction A of the female housing 2 without via a fitted portion in which the female housing 2 and the male housing 3 are fitted into each other is formed in the female housing 2 according to the present embodiment.

As shown in FIG. 2, the female housing cover 60 for guiding and protecting the electric wire is provided on an end surface of the female housing 2 into the side of which surface the lever 5 is inserted.

The lever insertion hole 6 is a cylindrical hole of a cylinder 9 protruding from a generally central portion of the female housing 2 on its non-fitted surface side toward a direction opposite to a direction in which the female housing 2 is fitted into the male housing 3, and is provided to penetrate a main body of the female housing 2.

Figure 8:
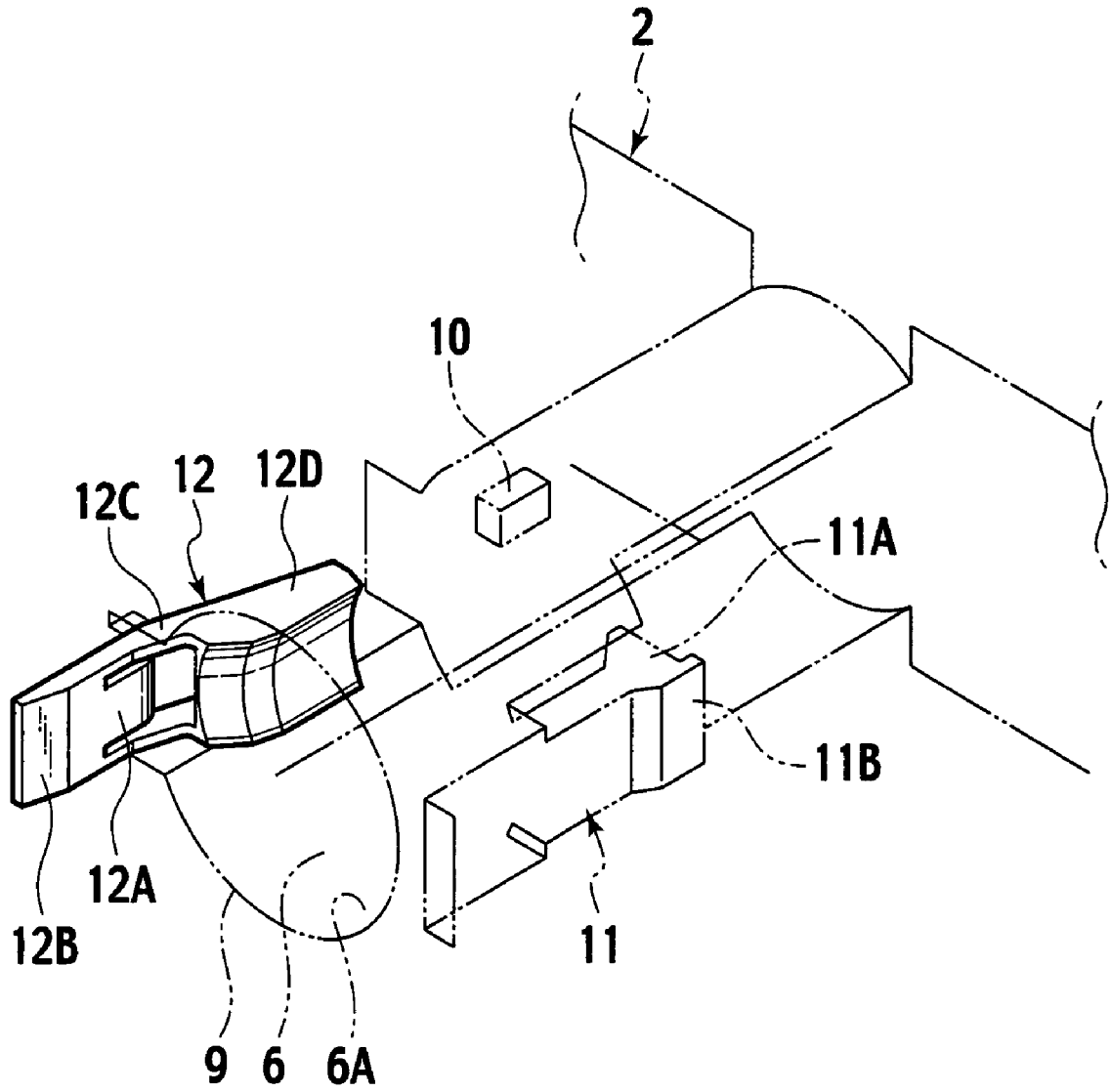
FIG. 8 is a perspective view of principal parts of the female housing according to the embodiment of the present invention.
Figure 9:
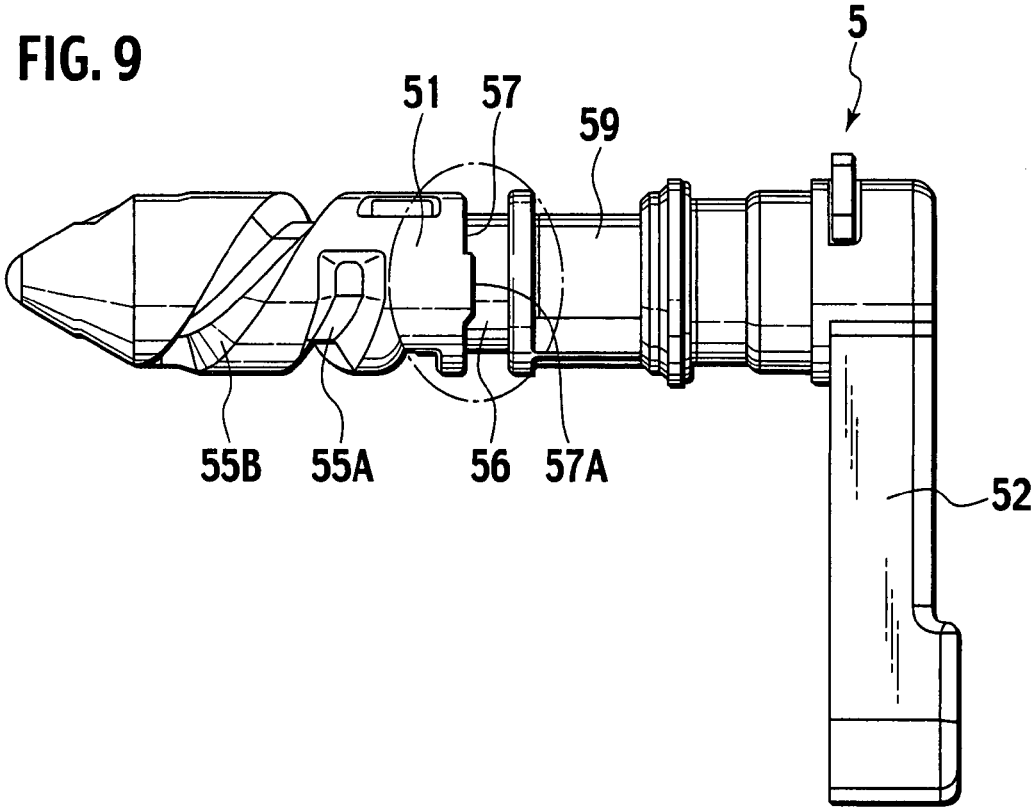
FIG. 9 is a side view of a lever according to the embodiment of the present invention.

As shown in FIGS. 5 and 8, a rib 10 protruding into the lever insertion hole 6, a flexible and arm-like lever holding lock 11 facing this lever insertion hole 6, and an anti-rotation lock 12 are provided on an inner wall 6A of the lever insertion hole 6.

The rib 10, which is a rectangular parallelepiped small protrusion, is configured to be thrust into a key groove 54 formed in the lever 5 and serving as a guide groove, to be described later, when the lever 5 is at a predetermined rotation angle with respect to the female housing 2.

Figure 6:
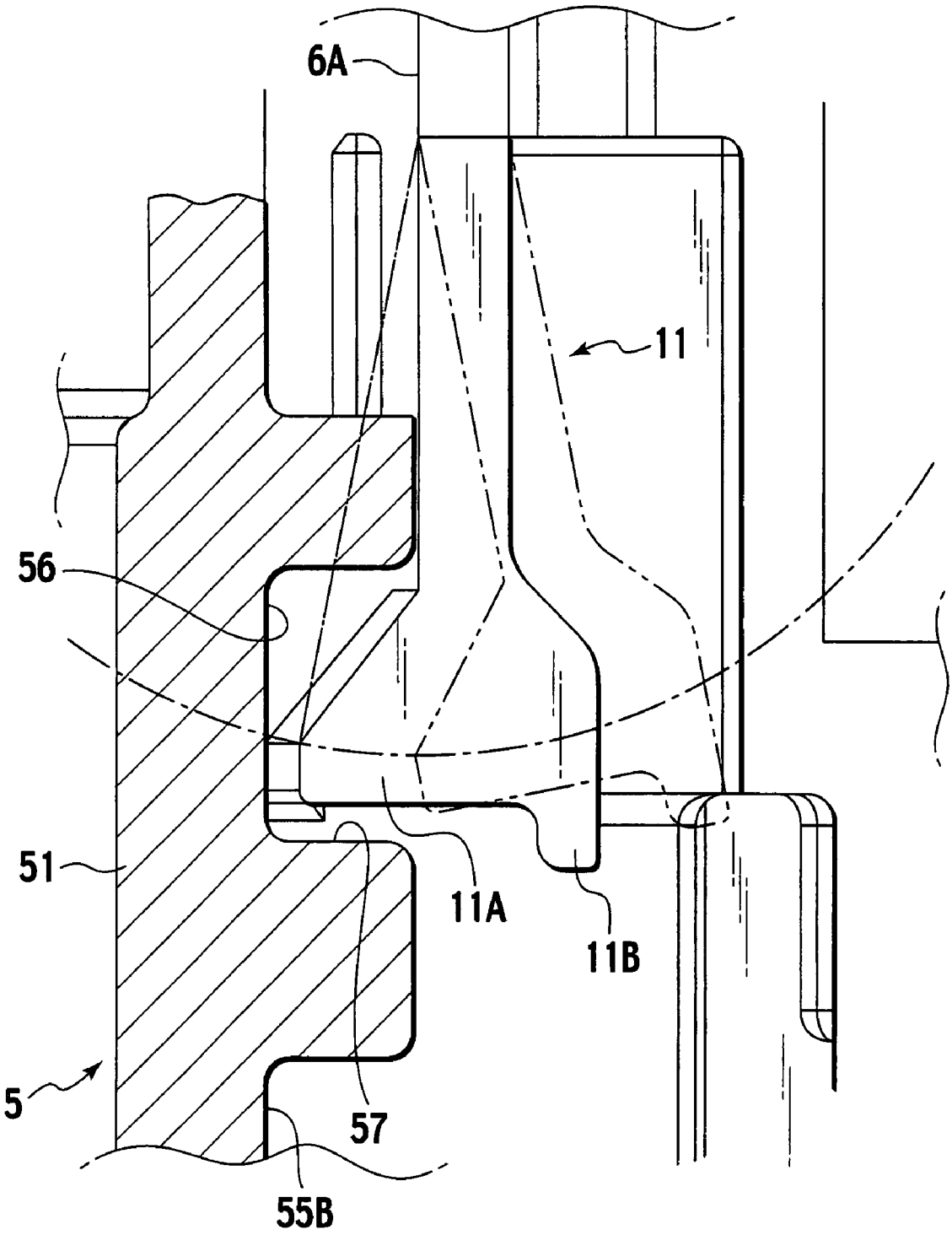
FIG. 6 is a cross-sectional view of principal parts of the lever-fitting type connector according to the embodiment of the present invention.

As shown in FIGS. 5 and 6, the lever holding lock 11 forms a part of the inner wall 6A of the lever insertion hole 6, and a lever holding protrusion 11A protruding into the lever insertion hole 6 is formed on a free end of the lever holding lock 11. Further, a lever release protrusion 11B into which a release tool (not shown) is caught protrudes toward the male housing 3 in the fitting directions A in an outside portion of the free end of the lever holding lock 11.

In the present embodiment, as shown in FIGS. 5 and 8, the rib 10 and the lever holding protrusion 11A of the lever holding lock 11 are arranged at positions almost identical in depth in the lever insertion hole 6, the positions of which are deviated from each other by about 90 degrees around a rotation axis.

Figure 7:
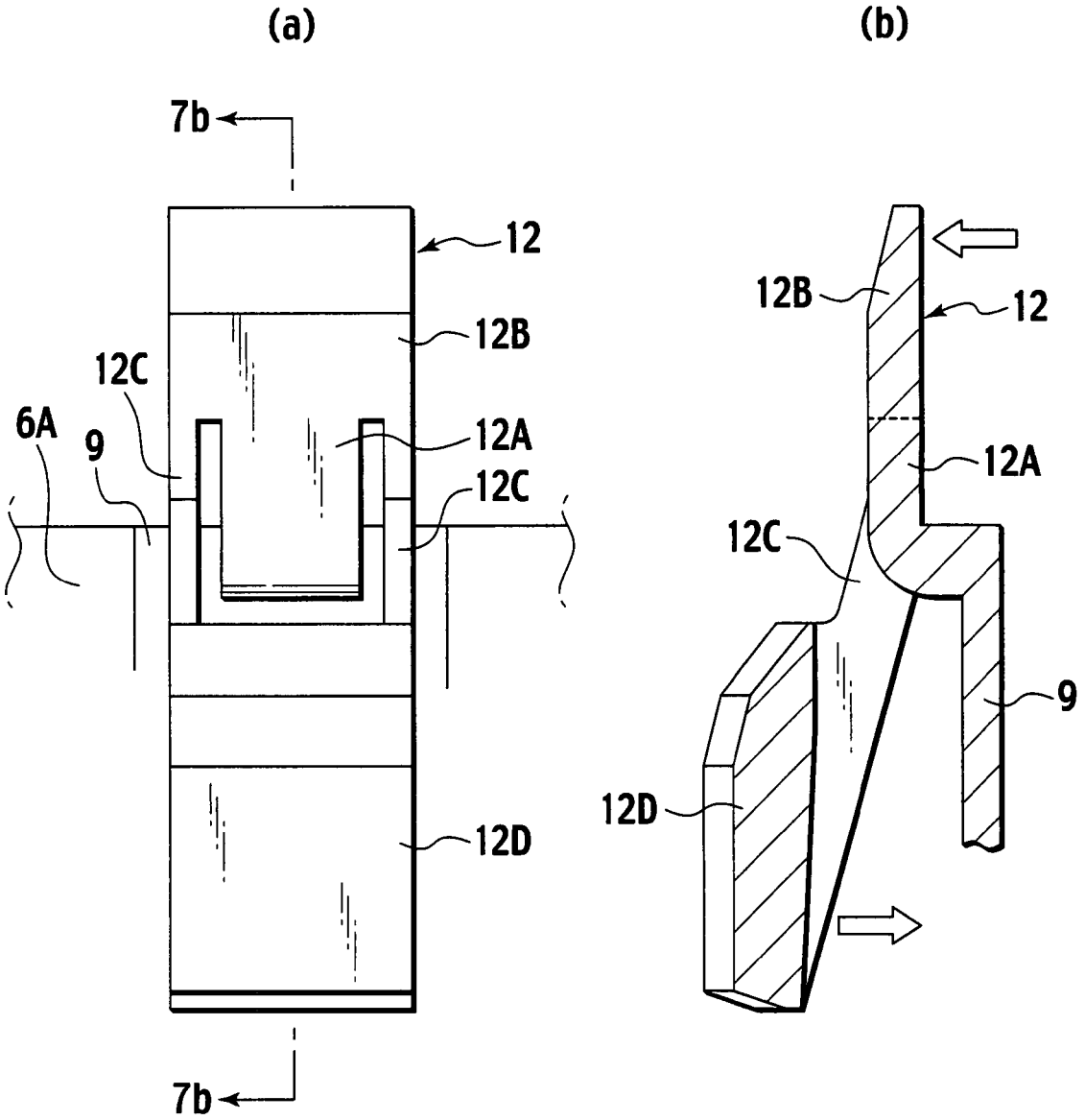
FIG. 7(*a*) is a front view of an anti-rotation lock of the lever-fitting type connector according to the embodiment of the present invention, and FIG. 7(*b*) is a cross-sectional view taken along 7*b*-7*b* of FIG. 7(*a*)

As shown in FIGS. 5, 7(*a*), and 7(*b*), the anti-rotation lock 12 is provided on an end of an inlet of the cylinder 9 of the female housing 2. This anti-rotation lock 12 has an intermediate portion formed integrally with the cylinder 9, and includes a support member 12A protruding from the end of the inlet of the cylinder 9 toward the center of the insertion hole 6, a release-operation plate member 12B rising from an end of the support member 12A and exhibiting repellence, trailing arms 12C extending from lower portions of respective both sides of the release-operation plate member 12B toward inward of the lever insertion hole 6, and a rotation locking member 12D that are ends of the paired trailing arms 12C and that serves as a generally-rectangular abutment member. This rotation locking member 12D is thrust into a rotation-locking concave portion 58 of the lever 5, to be described later, thereby preventing over-rotation of the lever 5.

Figure 12:
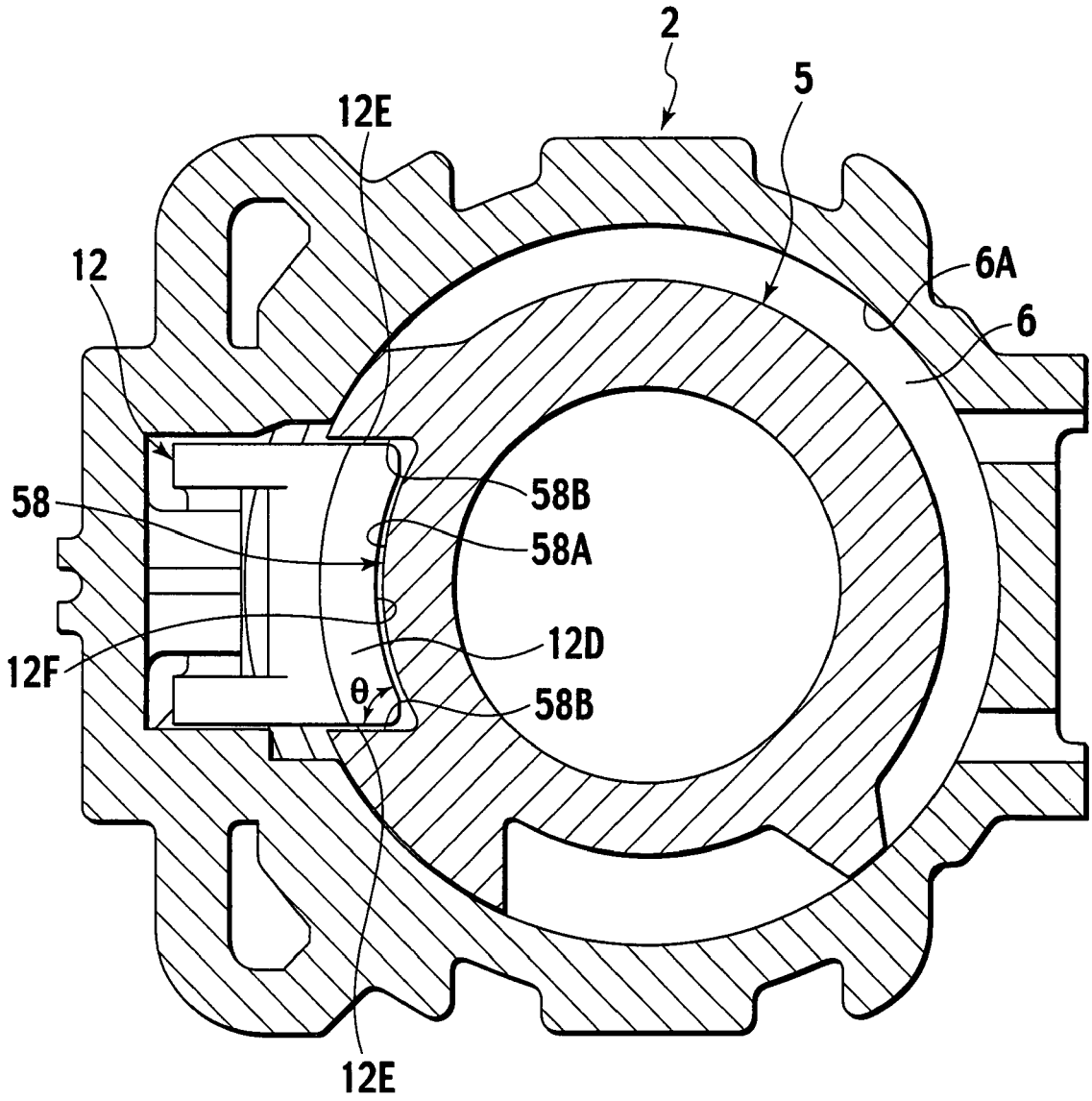
FIG. 12 is a cross-sectional view taken along 12-12 of FIG. 11.

As shown in FIG. 12, each of both side surfaces 12E in a rotation direction of the lever 5 and an inner side surface 12F opposed to the lever 5 of the rotation locking member 12D are set to form an angle smaller than 90 degrees with respect to each other. Due to this, if the lever 5 is over-rotated, then the lever 5 abuts on a sidewall surface 58B of the rotation-locking concave portion 58, to be described later, and the rotation-locking member 12D is urged to be drawn in a direction of the lever 5. Accordingly, it is possible to prevent the anti-rotation lock 12 from being released by over-rotation of the lever 5.

As shown in FIG. 8, the rotation locking member 12D of the anti-rotation lock 12 is located to be shifted toward a lever inlet side of the lever insertion hole 6 with respect to the rib 10 and the lever holding protrusion 11A of the lever holding lock 11 on the inner wall 6A of the lever insertion hole 6. Furthermore, in the present embodiment, the anti-rotation lock 12 is arranged at a position at 180 degrees with respect to the lever holding lock 11, that is, at a position opposed to the lever holding lock 11 around the rotation axis of the lever insertion hole 6.

Moreover, as shown in FIG. 1, a partition plate 13 that divides the through wiring path 8 from the fitted portion of the female housing 2 is formed on the side of the female housing 2 on which side the female housing 2 is fitted into the male housing 3.

[Configuration of Female Housing Cover]

A configuration of the female housing cover 60 will be described next with reference to FIG. 2. This female housing cover 60 is attached onto the non-fitted surface of the female housing 2. The female housing cover 60 is configured so that a cover main body 62, which covers up the non-fitted surface of the female housing 2 and in which a plurality of engagement portions 61 to be engaged with a peripheral edge portion of the female housing 2 is formed, is formed integrally with a wire leading member 63 extending sideways from the cover main body 62.

The cover main body 62 is generally circular, and a cylindrical insertion port 64 into which the above cylinder 9 of the female housing 2 is to be fitted is formed at center of the cover main body 62. Furthermore, a notch space 65 having a generally fan-shaped flat surface is formed from a part of the cylindrical insertion port 64 to outside so as to communicate with this cylindrical insertion port 64. This notch space 65 is used as a space for operating the release-operation plate member 12B of the anti-rotation lock 12 formed on the cylinder 9 via the grommet 70 to be described later.

Accordingly, a position at which the female housing cover 60 is attached onto the female housing 2 is set so that the release-operation plate member 12B provided on the cylinder 9 is opposed to the notch space 65 when the cylinder 9 is inserted into the cylindrical insertion port 64.

Moreover, the wire leading member 63 bundles and orients a wire connected to the female-terminal metal fittings (not shown) of the female housing 2 and the wire arranged to pass through the through wiring path 8, and functions to protect these wires.

[Configuration of Grommet]

A configuration of the grommet 70 will be described next with reference to FIG. 3. The grommet 70 is a waterproof rubber cover covering up the female housing cover 60 and having flexibility, and is configured so that a grommet main body 71 generally cylindrical container-shaped and covering up the cover main body 62 of the female housing cover 60, a leading member 72 covering up the wire leading member 63 of the female housing cover 60, and a bellows-like bundling cylinder 73 extending from an end of the leading member 72, bundling the wires, and having flexibility are formed integrally with one another.

Figure 13:
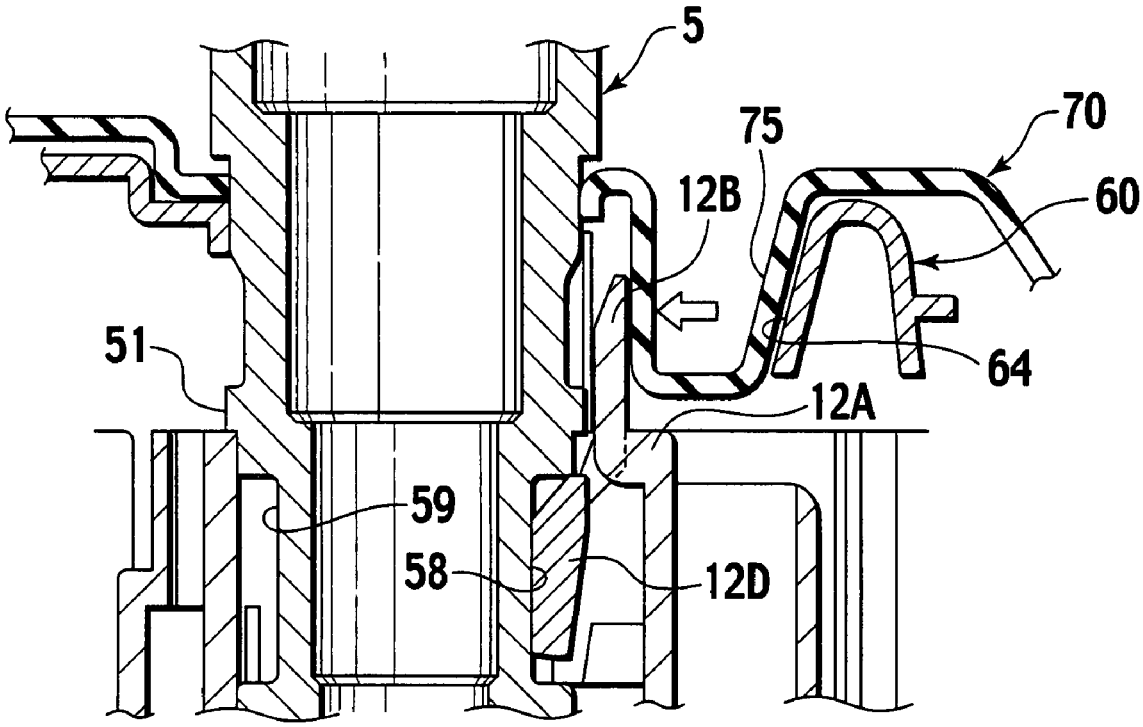
FIG. 13 is a cross-sectional view of principal parts of the lever-fitting type connector according to the embodiment of the present invention.

A lever inlet 74 that communicates with the lever insertion hole 6 and the cylindrical insertion port 64 of the female housing cover 2 when the female housing 2 is mounted with the female housing cover 60 is formed at center of the grommet main body 71. A release-operation concave portion 75 is formed at a predetermined position of a side of this lever inlet 74. As shown in FIG. 13, the position of the release-operation concave portion 75 is set so that the release-operation concave portion 75 is opposed to the release-operation plate member 12B of the anti-rotation lock 12 provided on the above female housing 2 along an outer side surface of the release-operation plate member 12B.

Furthermore, the release-operation plate member 12B forms a space into which a finger can be inserted.

[Configuration of Male Housing]

A configuration of the male housing 3 will be described next with reference to FIGS. 1, 4, and 5. A hood member 14 protruding toward the female housing 2 is formed on a fitted surface of a main body of the male housing 3, and the female housing 2 is fitted into this hood member 14. The hood member 14 is shaped to surround a portion of the male housing 3 in which portion the female housing 2 is fitted into the male housing 3, and structured so that the partition plate 13 of the female housing 2 is arranged outside of the hood member 14 when the female and male housings 2 and 3 are fitted into each other. Moreover, a plurality of cavities 15 is formed in the main body of the male housing 3 within the hood member 14 along the fitting directions A. A male-terminal metal fitting (not shown) is stored and fixed in each of these cavities 15, and the male-terminal metal fittings protrude into the hood member 14.

A pair of lever engagement plates 16, which are opposed to each other and opposed surfaces of which form a part of a circumferential surface of an imaginary cylinder, are provided at a generally central portion of the male housing 3 to protrude into the hood 14. It is to be noted that the opposed surfaces of these paired lever engagement plates 16 are set to have such dimensions as to slidably contact with an outer circumferential surface of the lever 5. A penetrating hole (not shown) into which the lever 5 is to be fitted is formed between bases of the paired lever engagement plates 16. Furthermore, engagement protrusions 16A to be captured by and stored in screw grooves 55A and 55B formed on the outer circumferential surface of the lever 5, to be described later, protrude at positions at which they are opposed each other on the opposed surfaces of the paired lever engagement plates 16, respectively.

[Configuration of Moving Plate]

A configuration of the moving pate 4 will be described with reference to FIG. 1. The moving plate 4 is shaped to be stored in the hood member 14 of the male housing 3, and a plurality of terminal insertion holes 17 into which the respective male-terminal metal fittings (not shown) protruding in the hood member 14 are inserted is formed in the moving plate 4. A generally rectangular notch 18 into which the paired lever engagement plates 16 within the hood member 14 of the male housing 3 are inserted is formed in the moving pate 4. Stopper pieces 19 temporarily stopped on the male housing 3 side and engaged with stopper protrusions (not shown) formed at the female housing 2 when the female and male housings 2 and 3 are connected to each other are formed in four corners of this notch 18, respectively, to protrude toward the female housing 2. Furthermore, stopper pieces 20 are formed to protrude in two portions of a peripheral edge of the moving plate 4, respectively.

[Configuration of Lever]

A configuration of the lever 5 will be described next. In the present embodiment, as shown in FIGS. 1, 4, 5, and 9, the lever 5 is configured so that a lever main body 51 to be inserted into the female and male housings 2 and 3, and operating units 52 and 53 provided on a rear end of the lever 5 on opposite side to a direction in which this lever main body 51 is inserted into the female housing 2 for manually performing a rotation operation are formed. The operating unit 52 is a relatively long rod-like grip member provided at right angle with respect to the lever main body 51, and the operating unit 53 is provided at a predetermined angle (which is about 70 degrees in this embodiment) with respect to the operating unit 52 and at right angle with respect to the lever main body 51.

The lever main body 51 is set to have a length so as to at least penetrate the lever insertion hole 6 of the female housing 2 and arrive between the paired lever engagement plates 16 of the male housing 3 in a state where the female housing 2 is not fitted into the male housing 3 and where the both housings 2 and 3 abut on each other.

A tip end of the lever main body 51 is formed to be tapered toward the tip end. Because of such a structure tapered toward the tip end, the lever main body 51 can be easily guided to the lever insertion hole 6 of the female housing 2 and to between the paired lever engagement plate 16 of the male housing 3.

Figure 4:
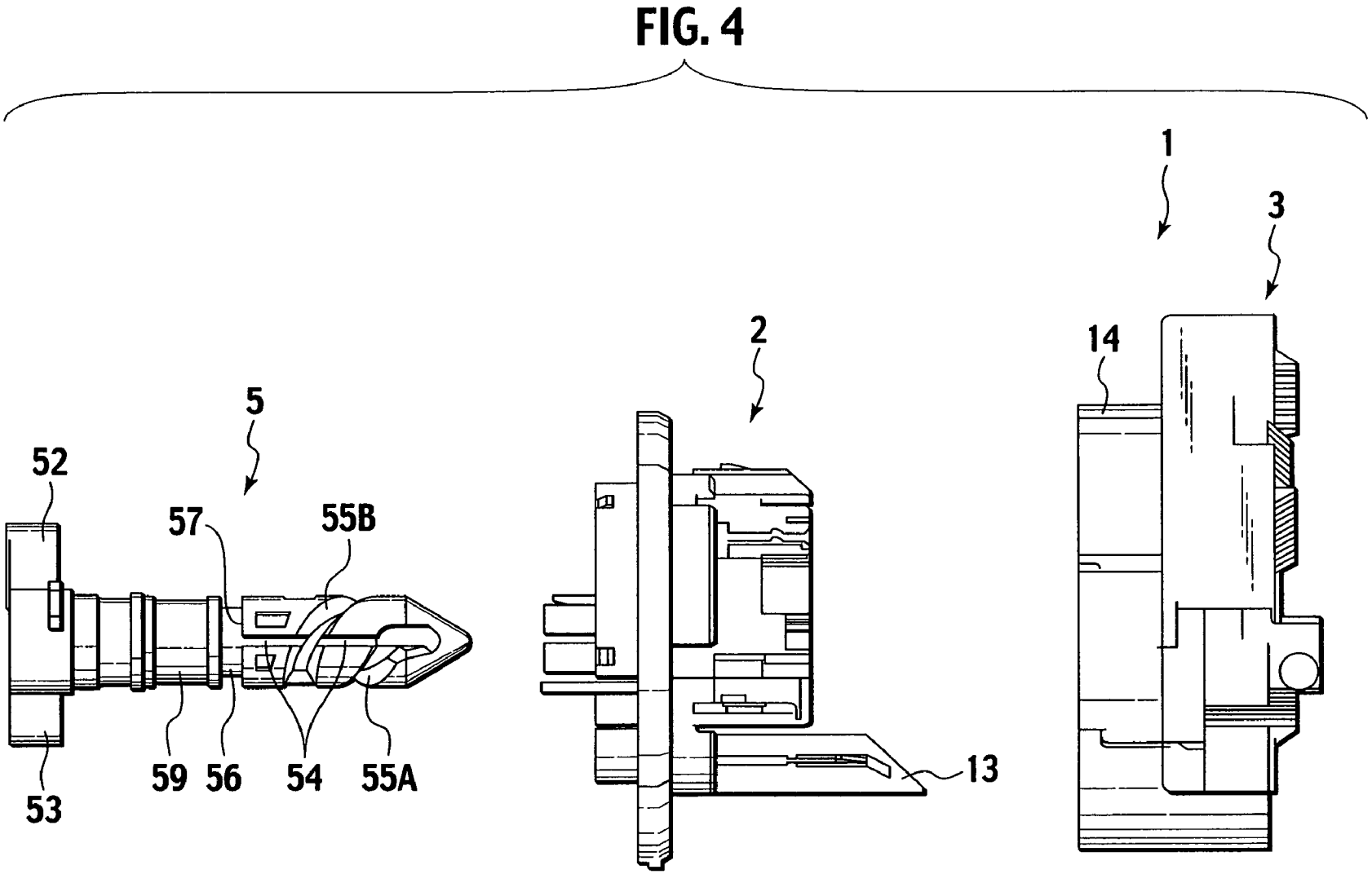
FIG. 4 is an exploded side view of the lever-fitting type connector according to the embodiment of the present invention.

Moreover, as shown in FIGS. 1, 4, and 5, one key groove 54 serving as a linear guide groove having a predetermined length from the tip end of the lever main body 51 along axial direction is formed on a circumferential surface of the lever main body 51. The screw grooves 55A and 55B each almost making a turn are formed in a range shorter than the length of the key groove 54 from the tip end of the lever main body 51 in parallel to start spirally at opposed circumferential surfaces of the tip end portion, respectively.

This key groove 54 is set to have such a length that both starting points (tip ends) of the screw grooves 55A and 55B on the tip end portion can pick up (store) the engagement protrusions 16A protruding on the opposed surfaces of the respective paired lever engagement plates 16 of the male housing 3 when a rear end of the key groove 54 is inserted into positions of the rib 10 and the lever holding protrusion 11A of the lever holding lock 11.

Figure 10:
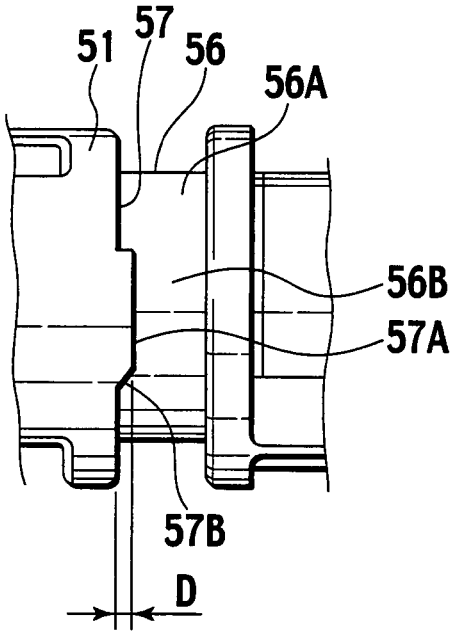
FIG. 10 is a side view of principal parts of the lever according to the embodiment of the present invention.

Moreover, the rear end of the key groove 54 is formed to be continuous with a lever retaining groove 56 formed circumferentially around the lever main body 51. As shown in FIG. 10, a stepped portion 57A is formed in a predetermined area of a wall member (sidewall surface) 57 of this lever retaining groove 56 located on the tip end side of the lever main body 51. One end of the stepped portion 57A is formed to be continuous with the wall member 57 via a tapered surface 57B. The stepped portion 57A has a height difference D from the wall member 57.

Furthermore, as shown in FIGS. 1 and 5, a rotation-locking concave portion 58 in which the rotation locking member 12D of the anti-rotation lock 12 is to be stored and serving as an abutted portion is formed in rear of the lever retaining groove 56 of the lever main body 51 (on a rear end side of the lever main body 51). As shown in FIG. 12, this rotation-locking concave portion 58 is set to be located at a position so that the rotation locking member 12D of the anti-rotation lock 12 is stored in the rotation-locking concave portion 58 when the lever 5 is operated to complete connection between the female housing 2 and the male housing 3. Further, as shown in FIG. 12, a length of the rotation-locking concave portion 58 in a circumferential direction of the lever main body 51 is set to be slightly larger than a width of the rotation locking member 12D. FIG. 12 is a cross-sectional view taken along 12-12 of FIG. 11. As shown in FIG. 12, the rotation-locking concave portion 58 includes a bottom 58A that is a part of the circumferential surface of the lever 5 and sidewall surfaces 58B provide on both sides of the rotation-locking concave portion 58, respectively and rising outward from the bottom at an angle θ smaller than 90 degrees.

[Function and Operation of Lever-Fitting Type Connector]

A function and an operation of the lever-fitting type connector 1 according to the present embodiment will be described.

(Connection Operation)

Figure 11:
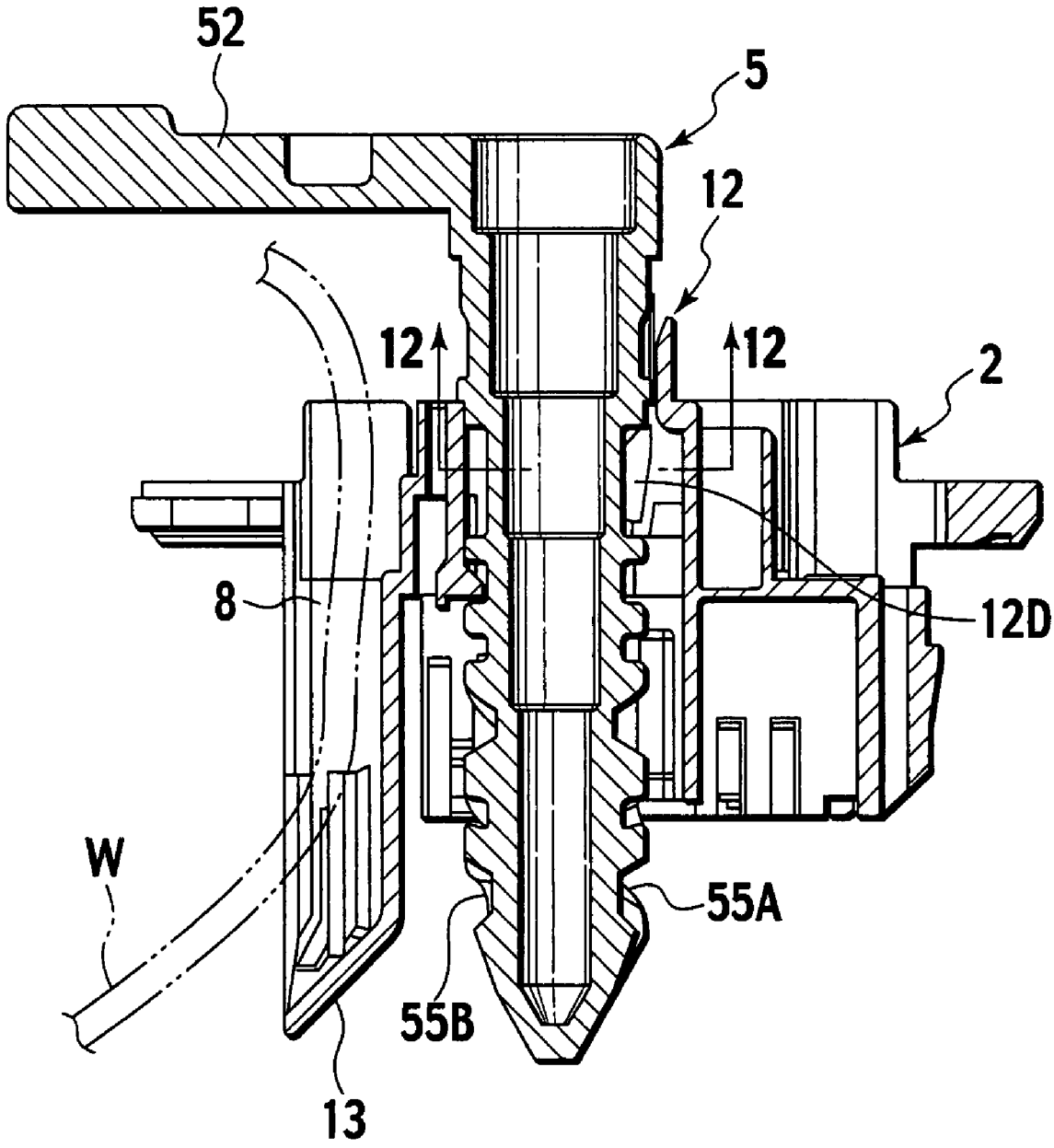
FIG. 11 is a cross-sectional view showing a state where the female housing is fully engaged with the lever in the lever-fitting type connector according to the embodiment of the present invention.

First, as shown in FIG. 1, the moving plate 4 is temporarily stopped at the male housing 3. At this time, the male-terminal metal fittings (not shown) protruding in the hood member 14 of the male housing 3 are inserted into the corresponding terminal insertion holes 17 formed in the moving plate 4, respectively. As shown in FIG. 11, a wire harness W necessary for through wiring is inserted into the through wiring path 8 of the female housing 2.

Next, connected surfaces of the female housing 2 and the male housing 3 are abutted against each other and temporarily stopped at each other. The tip end side of the lever 5 is then inserted into the lever insertion hole 6 from the female housing 2 side. At this time, the lever 5 is rotated to be placed so that the key groove 54 formed in the lever main body 51 of the lever 5 can store therein the rib 10 protruding into the lever insertion hole 6. By doing so, since the key groove 54 is the linear groove along the axial direction of the lever main body 51, the lever main body 51 can be inserted into the lever insertion hole 6 while the rib is stored in the key groove 54.

Thereafter, as the insertion of the lever main body 51 into the lever insertion hole 6 proceeds, the rib 10 abuts on a sidewall of the lever retaining groove 56 and further insertion is thereby prevented. In this manner, simultaneously with movement of the rib 10 to the retaining groove 56, the lever holding protrusion 11A of the lever holding lock 11 overpasses the wall member 57 side and falls down into the retaining groove 56 due to the repellence as shown in FIG. 6. Forward and backward operations of the lever main body 51 are prevented by the lever holding protrusion 11A, whereby the lever 5 is temporarily stopped at the female housing 2. In this state, the lever holding lock 11 is stored in the retaining groove 56 after being bent outward; therefore, a dimension of the lever holding lock 11 corresponding to an overstroke thereof is present as a clearance between the lever holding lock 11 and the wall member 57.

At this moment, tip ends of the screw grooves 55A and 55B of the lever main body 51 are in states where they can cooperatively pick up the engagement protrusions 16A protruding on the opposed surfaces of the paired lever engagement plates 16. In addition, in this temporarily stopped state, the rotation locking member 12D of the anti-rotation lock 12 is stored in a concave portion 59 circumferentially adjacent to the rotation-locking concave portion 58 formed in the lever main body 51.

Next, in the present embodiment, the operating units 52 and 53 of the lever 5 thus temporarily stopped are rotated counterclockwise, whereby the tip ends of the screw grooves 55A and 55B pick up (store) the engagement protrusions 16A of the lever engagement plates 16, and the female housing 2 and the male housing 3 are drawn toward each other and fitted into each other.

When rotation of the lever 5 temporarily stopped at the female housing 2 reaches a predetermined rotation angle (about 340 degrees in this embodiment), the engagement protrusions 16A are located on rear ends of the screw grooves 55A and 55B. At this time, the rotation locking member 12D of the anti-rotation lock 12 overpasses the wall member that separates the concave portion 59 from the rotation-locking concave portion 58 and is stored in the rotation-locking concave portion 58. At this moment, the rotation locking member 12D is engaged with the rotation-locking concave portion 58 and the rotation operation (over-rotation) of the lever main body 51 turns into a prevented state (a fully stopped state). The lever holding protrusion 11A of the lever holding lock 11 makes relative movement along the wall member 57 and abuts on the stepped portion 57A via the tapered surface 57B to eliminate the clearance, so that it is possible to prevent the lever 5 from becoming shaky in the axial direction.

By preventing the rotation of the lever 5, the fitting of the female housing 2 into the male housing 3 is held without change in the positions of the engagement protrusions 16A relative to the screw grooves 55A and 55B.

(Release Operation)

An operation for releasing connection of the lever-fitting type connector 1 in the state where the female housing 2 is connected to the male housing 3 as stated above will be described next.

As shown in FIGS. 7(*b*) and 13, first, a finger is put into the release-operation concave portion 75 of the grommet 70 so as to press the release-operation plate member 12B toward inside of the lever insertion hole 6 (indicated by a thick arrow in FIG. 7B) via the rubber sidewall of the release-operation concave portion 75. By doing so, the rotation locking member 12D stored in the rotation-locking concave portion 58 is moved outward (indicated by a thick arrow in FIG. 7B) with the support member 12A used as a fulcrum, thus making the lever main body 51 rotatable.

In this state, the operating units 52 and 53 are grasped and rotated in opposite direction to the direction for the connection operation (clockwise in this embodiment) so that the key groove 54 formed in the lever main body 51 is collinear with the rib 10. As a result, the engagement protrusions 16A in the screw grooves 55A and 55B are guided and driven toward the tip ends of the screw grooves 55A and 55B, whereby the fitting of the female housing 2 into the male housing 3 is released. In this state, the lever holding protrusion 11A of the lever holding lock 11 is stored in the retaining groove 56. Due to this, the lever holding protrusion 11A abuts against the wall member 57 of the retaining groove 56, so that the lever main body 51 cannot be pulled out from the lever insertion hole 6.

In this state, the lever release protrusion 11B is bent outward toward a position indicated by a chain line shown in FIG. 6 using a release tool or the like, thereby making it possible to move the lever main body 51 in the axial direction. In this state, the lever main body 51 can be pulled out from the lever insertion hole 6.

The lever-fitting type connector 1 according to the embodiment of the present invention has be described so far. According to the embodiment, the rotation locking member 12D serving as the abutment member of the anti-rotation lock 12 provided on the inner wall 6A of the lever insertion hole 6 of the female housing 2 abuts on the rotation-locking concave portion 58 serving as the abutted member formed on the lever 5, thereby making it possible to prevent over-rotation of the lever. Further, the abutment surface of the rotation locking member 12D and the abutted surface of the rotation-locking concave portion 58 are inclined so that the rotation locking member 12D is drawn toward the lever at the time of over-rotation. It is, therefore, possible to make it difficult to release the anti-rotation lock 12 and ensure holding the state where the housings are fitted into each other.

Moreover, in the lever-fitting type connector according to the embodiment, the anti-rotation lock 12 has a so-called seesaw lock structure in which the release-operation plate member 12B and the rotation locking member 12D connected to the paired trailing arms 12C are rotated with the support member 12A used as the fulcrum. Therefore, by weakly pressing the release-operation plate member 12B from outside via the grommet 70, it is possible to easily release the lever rotation lock. Accordingly, the anti-rotation lock 12 can be operated from the side of the lever insertion hole 6 of the female housing 2, thus improving operability.

With the lever-fitting type connector 1 according to the embodiment described above, the lever 5 can be inserted into the lever insertion hole 6 only when the rib 10 provided on the inner wall 6A of the lever insertion hole 6 formed in the female housing 2 meshes with the key groove 54 formed in the lever 5. It is, therefore, possible to prevent the lever 5 from being inserted into the female housing 2 when the lever 5 is located at positions other than the predetermined rotation position and to prevent so-called connection error.

Moreover, according to the present embodiment, the lever holding lock 11 having flexibility and the rib 10 that are provided on the inner wall 6A of the lever insertion hole 6 simultaneously abut on the wall member 57 of the retaining groove 56 serving as a retaining unit formed in the lever 5, and can prevent the lever 5 from coming off and hold the lever 5. It is, therefore, possible to increase holding force for temporarily stopping (holding) the lever 5 at the female housing 2. Further, to release the lever 5, the axial movement of which is restricted by the lever holding lock 11 and the rib 10, from the female housing 2, it suffices to perform an operation for releasing only a state where the lever holding lock 11 is engaged with the lever 5 while the anti-rotation lock 12 is temporarily released. It is, therefore, possible to improve lever release operability.

Furthermore, according to the present embodiment, the rib 10 provided on the inner wall 6A of the lever insertion hole 6 is stored in the key groove 54 of the lever 5, whereby the lever 5 can be inserted into the lever insertion hole 6. It is, therefore, possible to set dimension for close fitting so as not to generate backlash between the lever insertion hole 6 and the lever 5. This can prevent the lever 5 from becoming shaky irrespectively of strength and magnitude of the lever holding lock 11 having flexibility. Accordingly, if the male housing 3 is to be connected to the female housing 2 by rotating the lever 5 while the lever 5 is being held at the female housing 2, then it is possible to suppress shaking the lever 5 and ensure connecting the male housing 3 to the female housing 2 side.

Moreover, according to the present embodiment, the rib 10 and the lever holding protrusion 11A of the lever holding lock 11 are arranged at the positions deviated from each other in the longitudinal direction of the lever main body 51 by as much as the overstroke of the lever holding lock 11. Due to this, as shown in FIG. 10, a wall surface of a wide portion 56 (the wall member 57) on which the rib 10 abuts and a wall surface of a narrow portion 56B (the stepped member 57A) on which the lever holding protrusion 11A of the lever holding lock 11 abuts while the lever 5 is in the fully stopped state are formed on the lever 5, thereby making it possible to prevent the lever 5 from becoming shaky. Specifically, the wall surface of the wide portion 56A (wall member 57) and that of the narrow portion 56B (stepped member 57A) are made continuous on the tapered surface 57B, whereby the female housing 2 is fitted into the male housing 3. Accordingly, when the lever 5 is rotated, the lever holding protrusion 11A of the lever holding lock 11 can slide on the tapered surface 57B and the wall surface of the narrow portion 56B (stepped member 57A) can smoothly move toward the lever holding protrusion 11A, thereby making it possible to improve operability.

Furthermore, according to the present embodiment, the operating units 52 and 53 are provide integrally with the base of the lever 5, thereby making it possible to facilitate rotating the lever 5.

OTHER EMBODIMENTS

The descriptions and drawings that constitute a portion of this disclosure should not be perceived as limiting the present invention. Various alternative embodiments, examples, and operational techniques will become apparent to persons skilled in the art from this disclosure.

For example, according to the embodiment described above, the lever-fitting type connector 1 is configured to temporarily stop the lever 5 at the female housing 2. Needless to say, the lever 5 can be temporarily stopped at the male housing 3.

Further, in the above embodiment, the instance of simply connecting the female housing 2 to the male housing 3 has been described. Alternatively, the present invention can be applied to a case where a car interior-side connector housing and an engine room-side connector housing are connected to each other via, for example, an instrument panel of a car between them. In this case, a penetrating hole is formed in the instrument panel, the other housing is temporarily stopped from an opposite side to the instrument panel while holding one housing at the instrument panel, and the lever 5 is rotated from, for example, the car interior side. It is thereby possible to connect the connector housings to each other and facilitate connector attachment operations and release operations.

INDUSTRIAL APPLICABILITY

According to the present invention, it is possible to provide a lever-fitting type connector that can ensure strong connection force between the connector housings and good lock releasing operability.

The invention claimed is:

1. A lever-fitting type connector comprising:

a first connector housing;

a second connector housing to be fitted into the first connector housing; and a lever rotatably held by the first connector housing, drawing the second connector housing by being rotated to fit the first connector housing and the second connector housing into each other, wherein the first connector housing includes an insertion hole into which the lever is to be inserted, and an anti-rotation lock that includes an abutment member abutting on an abutted member provided on the lever for preventing over-rotation of the lever is provided on an inner wall of the insertion hole, and an abutment surface of the abutment member in a circumferential direction of the insertion hole and an abutted surface of the abutted member in a circumferential direction of the lever are inclined so that the abutment member is drawn toward the lever when the lever is over-rotated.

2. The lever-fitting type connector according to claim 1, wherein the abutted surface is formed on each of both sides of the abutted member in the circumferential direction of the lever.

3. The lever-fitting type connector according to claim 1, wherein the abutted member is a rotation-locking concave portion formed on a circumferential surface of the lever.

4. The lever-fitting type connector according to claim 1, wherein the anti-rotation lock includes a support member protruding toward a center of the insertion hole;

a lock releasing unit extending from the support member in an opposite direction to an insertion direction of the lever;

a pair of arm members extending from the lock releasing unit in the insertion direction of the lever, the support member present between the pair of arms; and the abutment member formed to be connected to tip ends of the pair of arm members.

5. The lever-fitting connector according to claim 4, wherein the lock releasing unit is exposed to an opposite side of the first connector housing to a direction in which the first connector housing is fitted into the second connector housing.

6. The lever-fitting type connector according to claim 5, wherein the first connector housing is covered with a waterproof cover having flexibility, and the lock releasing unit can be operated from an outside of the waterproof cover.

7. The lever-fitting type connector according to claim 6, wherein a release-operation concave portion that enables operating the lock releasing unit is formed in the waterproof cover.

* * * * *